US005365219A

United States Patent [19]

Wong et al.

[11] Patent Number: 5,365,219

[45] Date of Patent: Nov. 15, 1994

[54] CONVERSATION LEVEL WARNING DEVICE

[75] Inventors: Stanley Wong, Vancouver, Canada; Michael H. Chang, 33 E. 47th Street, Vancouver, B.C., Canada, V5W 2A4; Robert Lee, Burnaby, Canada

[73] Assignee: Michael Hung Chang, Vancouver, Canada

[21] Appl. No.: 910,434

[22] Filed: Jul. 8, 1992

[51] Int. Cl.[5] ..... G08B 23/00; H04R 29/00

[52] U.S. Cl. ..... 340/573; 73/646; 340/529; 381/56

[58] Field of Search ..... 340/573, 540, 566, 529, 340/326; 73/646; 381/56; 446/175

[56] References Cited

U.S. PATENT DOCUMENTS

| | | | |
|---|---|---|---|
| 3,944,735 | 3/1976 | Willcocks | 381/20 |
| 4,250,499 | 2/1981 | Keinzle | 340/566 |
| 4,346,374 | 8/1982 | Groff | 340/573 |
| 4,386,343 | 5/1983 | Shiveley | 340/566 |
| 4,424,511 | 1/1984 | Alberts, Jr. | 73/646 |
| 4,481,504 | 11/1984 | Scott, II | 340/573 |
| 4,486,898 | 12/1984 | Yokoya | 381/15 |
| 4,509,189 | 4/1985 | Simpson | 381/56 |
| 4,520,503 | 5/1985 | Kirst et al. | 381/56 |
| 4,521,768 | 6/1985 | Haran et al. | 340/529 X |
| 4,633,234 | 12/1986 | Gagnon | 340/566 |
| 4,654,642 | 3/1987 | Groff | 340/573 |
| 4,853,677 | 8/1989 | Yarbrough et al. | 340/544 |
| 4,920,332 | 4/1990 | Philippe | 340/544 |
| 5,093,658 | 3/1992 | Grothause | 381/56 X |
| 5,220,309 | 6/1993 | Carder, Jr. | 340/573 |

*Primary Examiner*—Thomas Mullen

*Attorney, Agent, or Firm*—Norman M. Cameron

[57] ABSTRACT

A method and apparatus are provided for warning when the amplitude of conversations exceeds certain values. The apparatus includes a microphone and related circuitry which continuously produce a signal related to the amplitude of the conversation while the apparatus is operational. A comparator continuously compares the signal to a pre-set first value and produces an output as long as the signal indicates that the conversation exceeds a certain amplitude. There is a discriminator responsive to the comparator output which provides a discriminator output when the duration of the comparator output exceeds a pre-determined value. The discriminator is connected to an alarm which produces a warning signal when the discriminator provides the discriminator output. There may also be a second comparator which produces a visual signal when the amplitude of the conversation is above an amplitude which may be below the amplitude which activates the alarm.

1 Claim, 4 Drawing Sheets

CONVERSATION LEVEL WARNING DEVICE

BACKGROUND OF THE INVENTION

1. Field of the Invention

This invention relates to devices which provide a warning when sound levels exceed a certain level and, in particular, to devices which warn parties to a conversation when their voice levels become louder than normal.

2. Description of Related Art

When people engaged in a conversation begin to get emotional, their voice levels typically rise. Therefore, the rise in voice levels can be a warning sign that they are becoming angry. Sometimes this becomes a pattern of behavior between closely related persons, including spouses. They begin talking at normal levels, but one or both of them become emotional, their voice levels rise, and this leads to irrational shouting and possibly even violence.

Therefore, it would be desirable to provide some means for monitoring the level of the conversation and providing a warning when the participants in the conversation begin to raise their voices. Providing a suitable warning can break the pattern of behavior leading to disputes.

Various electronic devices have been developed in the past to provide a warning when certain sounds are detected. A well-known example would be intruder alarms, which typically provide an audible alarm when loud noises are detected such as the sound of breaking glass.

Devices have also been proposed which arc specifically adapted to monitor conversation levels. For example, U.S. Pat. No. 4,481,504 to Scott discloses a sound alarm device which listens to the sound level in an enclosure or other area for a predetermined interval of time. Subsequently, it does not listen for another predetermined interval of time. An alarm is sounded if a sound level of a predetermined magnitude is monitored during the first interval. The circuit is designed to omit alarms upon receiving quick, sharp noises such as a cough, hand clap, book dropping or the like. Proposed uses include classroom monitoring. The listening time is 0.5–0.7 seconds, while the off time is 5–6 seconds. Accordingly, it is a matter of probability whether a particular sound will occur during the listening time. Many angry words can be said in 5–6 seconds, and potentially this device would not provide any warning.

Another related device is the classroom noise alarm found in U.S. Pat. No. 4,346,374 to Groff. With this device, two time delay circuits are utilized, one with a 14 second delay and the other with a 5 second delay. When a noise beyond a certain threshold is detected, nothing happens for the next 14 seconds. However, if a loud sound occurs at any time within the next five seconds, then a warning is given by the device. While this may be suitable for classroom monitoring purposes, it renders the device totally unsuitable for avoiding arguments as intended by the present invention. Any prolonged period, particularly one as long as 14 seconds, gives ample opportunity for the parties to raise their voices and engage in verbal fights.

Accordingly, while various devices have been developed in the past, they are not ideally suited for purposes of monitoring conversations and avoiding arguments by giving a warning when voice levels rise.

SUMMARY OF THE INVENTION

It is an object of the invention to provide an improved electronic device for monitoring conversations which will give a warning when voice levels rise to indicate a potential emotional reaction.

It is also an object of the invention to provide an improved device of this type which will continuously monitor conversations and not ignore voice levels for periods of time which might give sufficient time for sharp words to be exchanged.

It is a further object of the invention to provide a device of this character which gives successive warnings when voice levels reach certain threshold levels, so that the parties will be warned well before shouting develops.

In accordance with these objects, the invention provides a sound level warning apparatus which is responsive to the amplitude of an ambient conversation. The apparatus includes a microphone and related circuit which continuously produce a signal related to the amplitude of the conversation while the apparatus is operational. There is a comparator which continuously compares the signal to a preset value and produces an output when the signal reaches a value indicating that the conversation is exceeding a certain amplitude. There is a discriminator responsive to the comparator output which provides a discriminator output when the duration of the comparator output exceeds a predetermined value. There is an alarm coupled with the discriminator which produces a warning signal when the discriminator provides the discriminator output.

Preferably, the alarm is audible. There may also be one or more visual indicators, such as LED's, which give warnings when the amplitude reaches certain levels below the amplitude which triggers the audible alarm.

DESCRIPTION OF THE PREFERRED EMBODIMENTS

Figure 1:
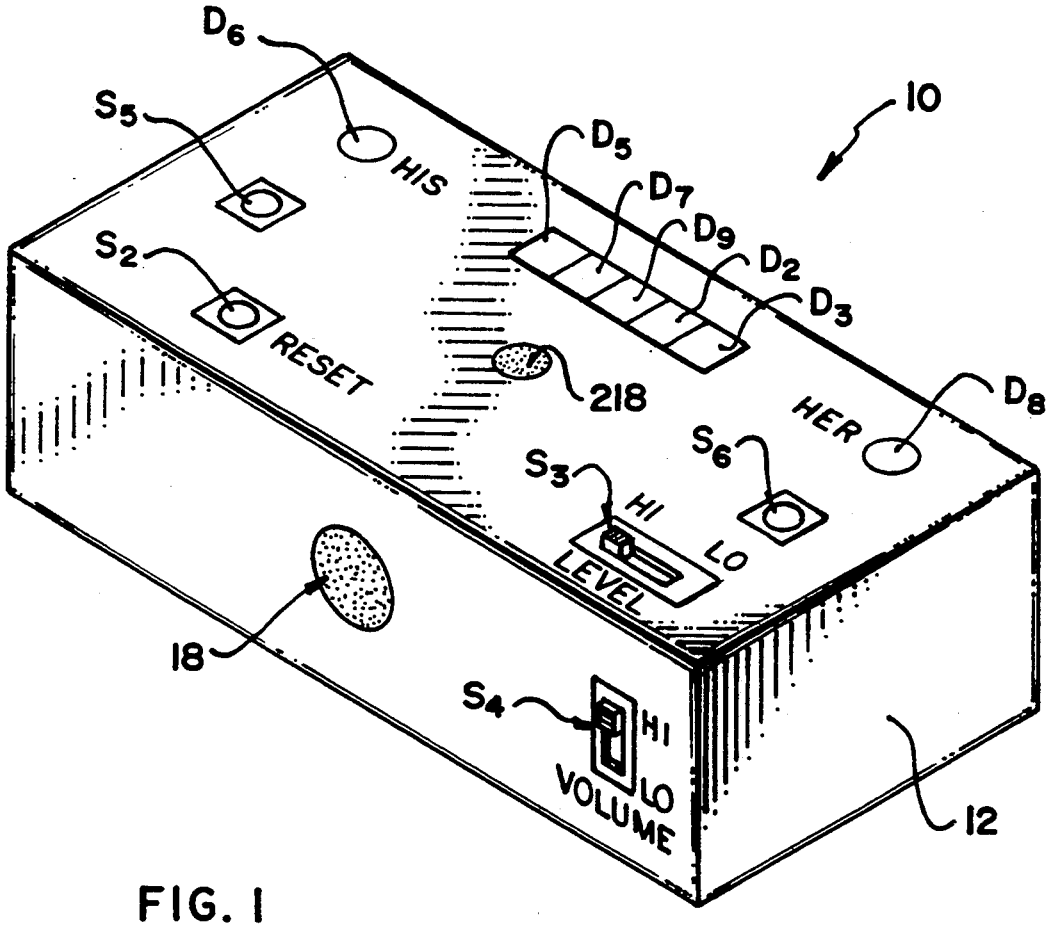
FIG. 1 is a top, front isometric view of a sound level warning apparatus according to an embodiment of the invention.
Figure 2:
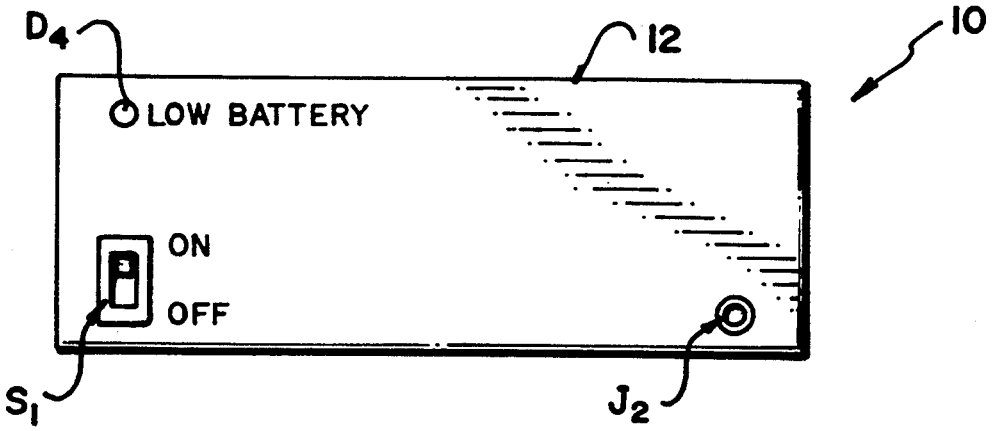
FIG. 2 is a rear view thereof.

The drawings show an example of the invention in the form of a sound level warning apparatus 10. As shown in FIG. 1 and FIG. 2, the apparatus has a box-like body 12 in this example, although this is not critical. There is an on/off switch $S_1$ for turning the device on or off and a sound level adjustment switch $S_3$ which allows the users to adjust the sound levels which will trigger the various warnings and alarm described below. A reset switch $S_2$ is used to stop the alarm and reset the apparatus. There is a microphone 18 for picking up the ambient sound and five LED's $D_5$, $D_7$, $D_9$, $D_2$ and $D_3$ which give the visual indications of the sound level. In this particular example, LED's $D_5$ and $D_7$ are green, and light when conversation levels are normal. LED's $D_9$ and $D_2$ are yellow, and give an initial warning when conversation levels rise beyond a level deemed to be normal. LED $D_3$ is red, and lights when conversation levels are excessive.

A secondary function of apparatus is to allow two parties to speak in turn without interruption. This is fulfilled by HIS switch $S_5$ and HER switch $S_6$ which cause LED's $D_8$ and $D_6$ respectively to light when pushed, indicating the person who is to speak.

Figure 3:
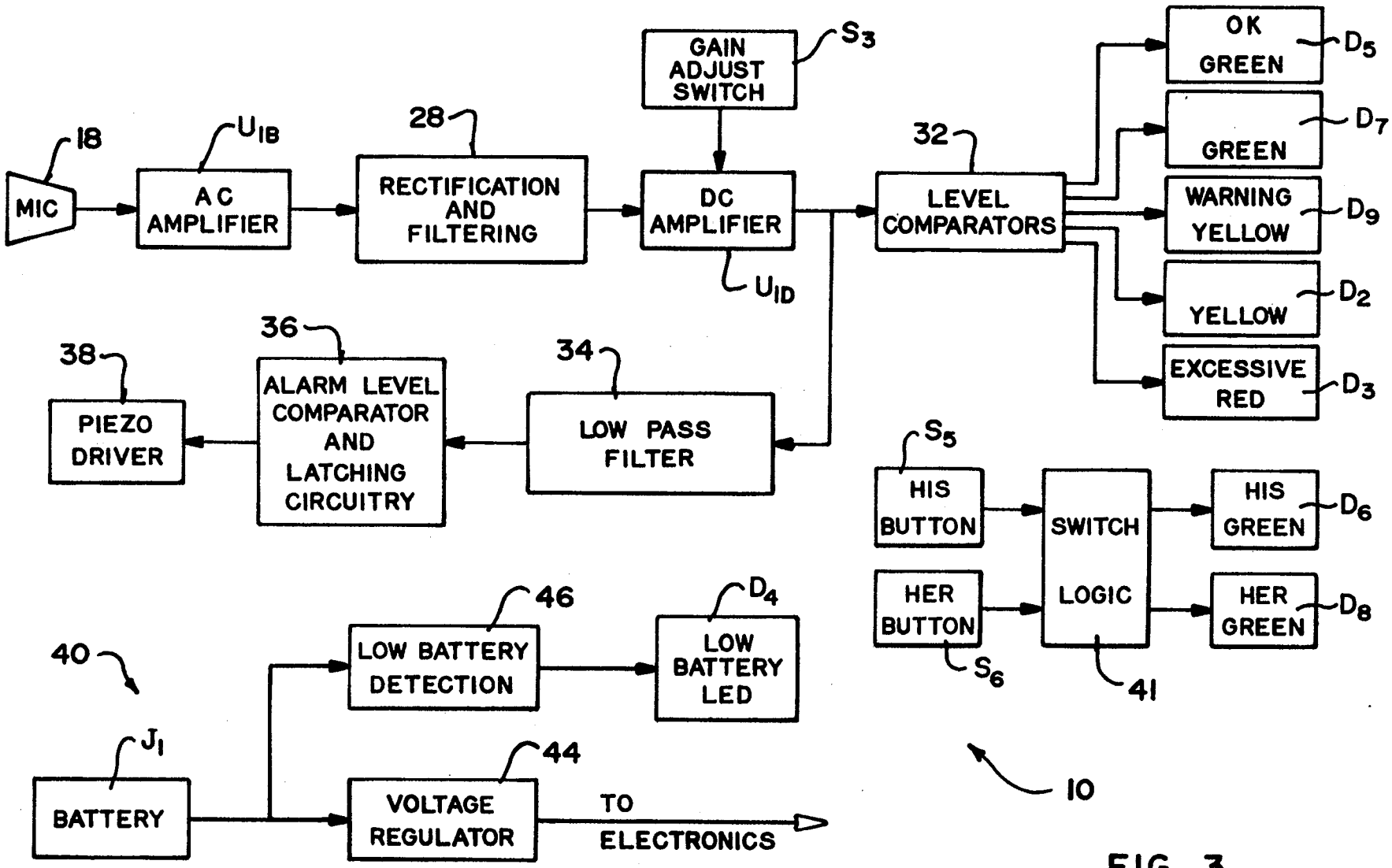
FIG. 3 is a block diagram thereof.

The general operation of the apparatus 10 may be best appreciated by initially referring to the block diagram comprising FIG. 3. Microphone 18 picks up sound and converts it to an electronic signal which is sent to AC amplifier $U_{1B}$. The AC amplifier is connected to a rectification and filtering circuit 28, which filters the signal and converts it to a ZDC signal. The DC signal is amplified by DC amplifier $U_{1D}$ which is connected to a level comparator circuit 32, as well as to a low pass filter 34. The gain of $U_{1D}$ is adjustable through gain adjust switch $S_3$.

The level comparator circuit 32 includes five level comparators described below which are connected to green LED's $D_3$ and $D_7$, yellow LED's $D_9$ and $D_2$, and red LED $D_3$ respectively. These give visual indications of the sound level.

The low pass filter 34 provides suitable integration of the DC signal received from amplifier $U_{1D}$. It ensures that an audible alarm is given only if the noise level is above a certain threshold for an extended period of time, which is 2–3 seconds. This ensures that there is less susceptibility to false alarms.

The output of the low pass filter is connected to an alarm level comparator and latching circuitry 36. This circuitry is in turn connected to piezo driver 38 of an audible alarm described in more detail below. The alarm level comparator portion of circuitry 36 functions in the same manner as level comparator 32, and the purpose is to determine whether the amplitude of the sound received by the microphone is high enough to sound the alarm. The latching portion of the circuitry is used so that the alarm is sounded until reset switch $S_2$ is closed.

A secondary function of apparatus 10 is to control the flow of conversation. This is achieved by switch logic 41 and "HIS" and "HER" buttons $S_5$ and $S_6$ and their associated LED's $D_6$ and $D_8$. Depressing the HIS button causes the switch logic to turn on HER LED $D_8$. Activating the HER button turns on HIS LED $D_6$. This helps to teach the parties to speak one at a time.

The bottom half of the diagram shows the power supply 40 for the apparatus 10. In this case, a battery $J_1$ is used, although the device could be operated by household current with a suitable voltage converter and rectifier. The battery is connected to a voltage regulator circuit 44 which regulates the voltage to provide the regulated power $V_{cc}$ used by the electronic circuits above. The battery is also connected to a low battery detection circuit 46 which is connected to another LED $D_4$. The low battery detection circuit compares the battery voltage to a reference voltage, and turns on LED $D_4$ if the battery voltage falls below the reference level.

DETAILED CIRCUIT DESCRIPTION

Figure 4A:
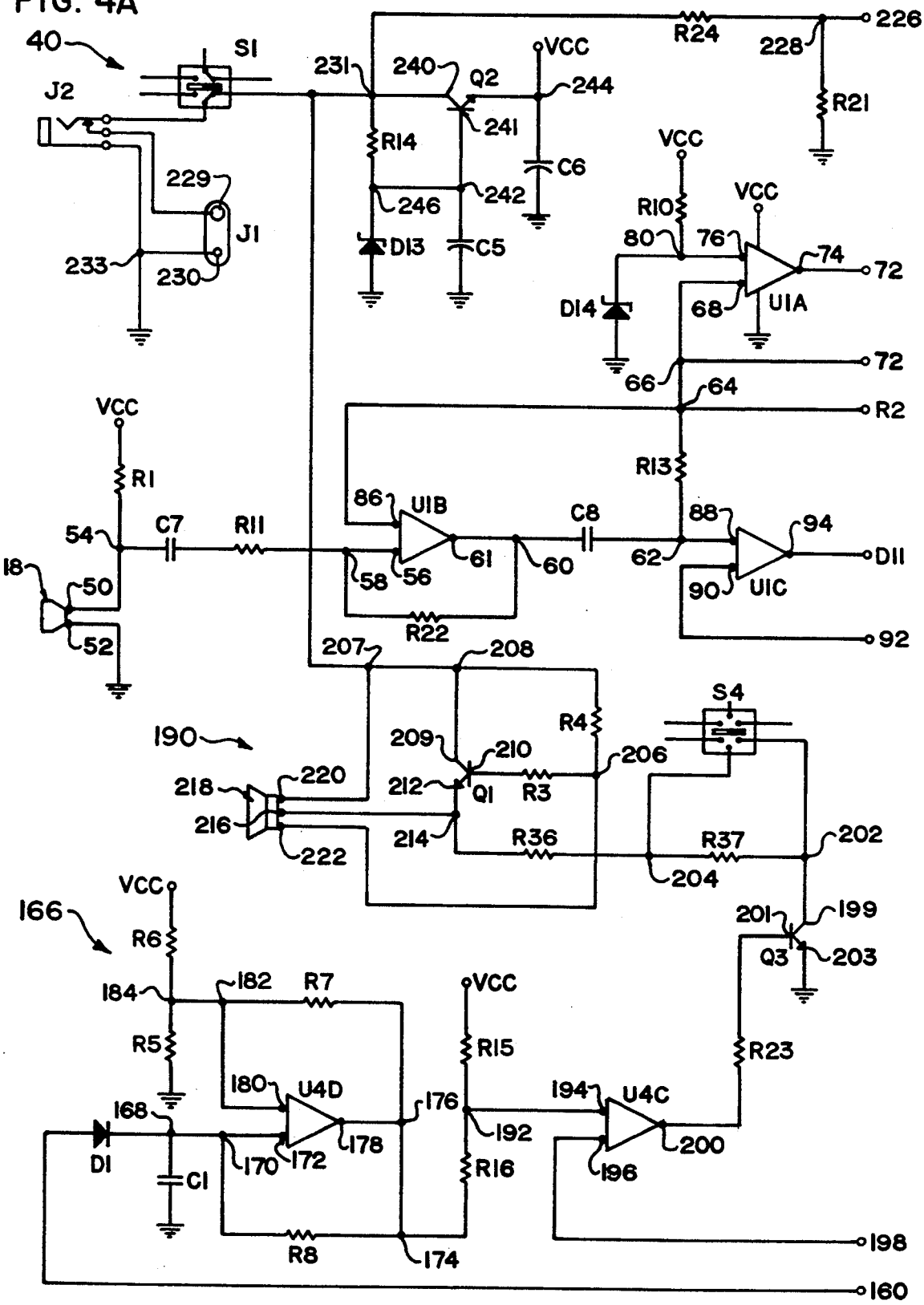
FIG. 4 is a circuit diagram thereof.
Figure 4B:
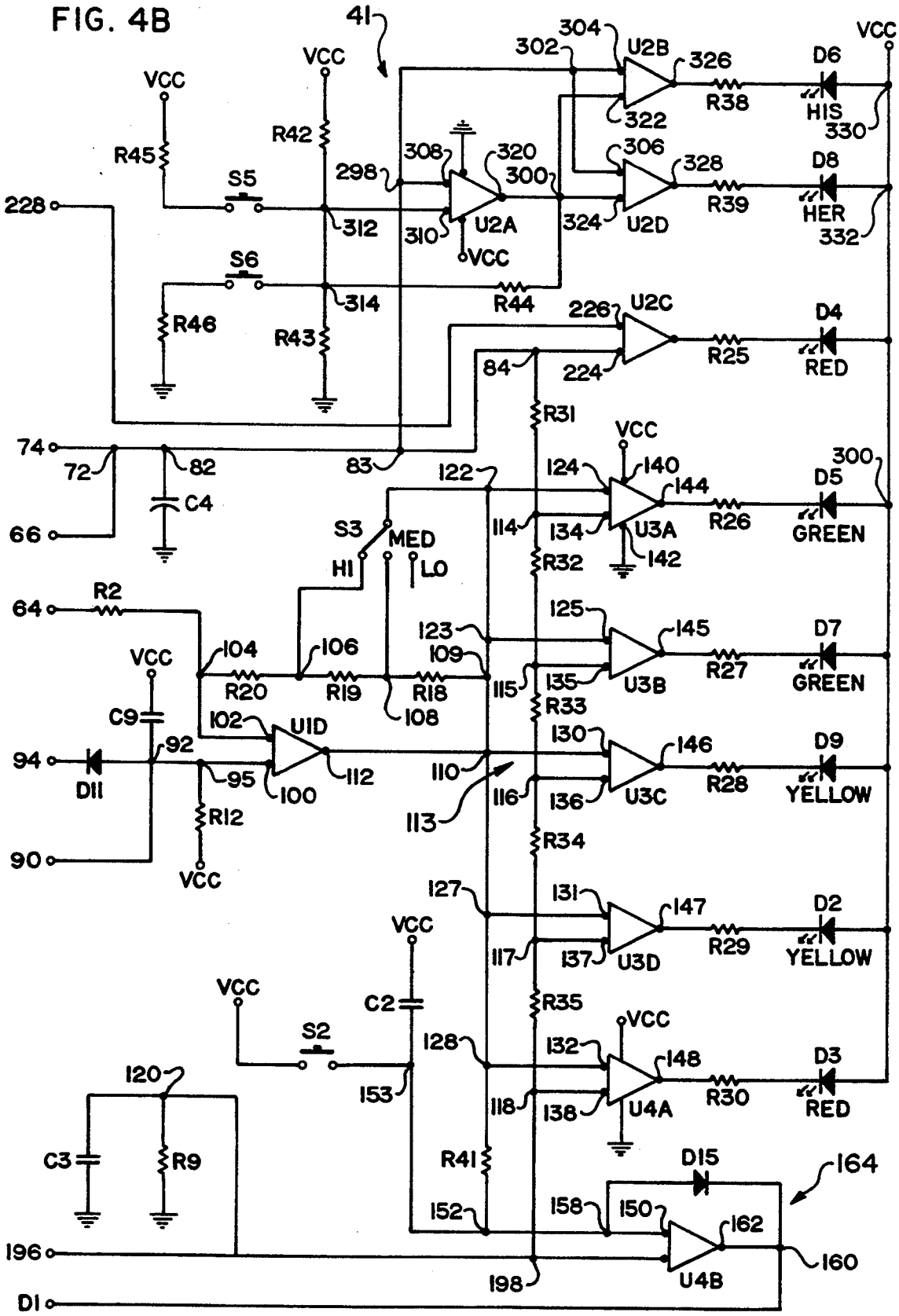

The following is a list of components of the circuit shown in FIG. 4:

| Quantity | Reference | Part |
|---|---|---|
| | CAPACITORS | |
| 4 | C1, C2, C7, C8 | 1 μF |
| 3 | C3, C4, C5 | 10 μF 10 V |
| 2 | C6 | 470 μF 10 v ELEC RADIAL |
| 1 | C9 | 100 μF |
| | DIODES | |
| 3 | D1, D11, D15 | 1N4148 |
| 1 | D16 | IN52288 |
| 2 | D9, D2 | LED MV53124A YELLOW |
| 1 | D3 | LED MV57124A RED |
| 1 | D4 | LED RED |
| 2 | D5, D7 | LED MV54124A GREEN |
| 2 | D6, D8 | LED GREEN |
| 1 | D13 | 1N5235B 6v8 |
| | TRANSISTORS | |
| 3 | Q1, Q2, Q3 | 2N3904 |
| | RESISTORS | |
| 2 | R1, R2 | 12K ohms |
| 1 | R31 | 4K7 ohms |
| 4 | R3, R11, R44, R33 | 10K ohms |
| 1 | R14 | 510 ohms |
| 6 | R4, R5, R6, R7, R8 R41 | 220K ohms |
| 1 | R9 | 51K ohms |
| 5 | R10, R12, R15, R42, R43 | 100K ohms |
| 2 | R13, R21 | 47K ohms |
| 6 | R23, R25, R36, R37, R45, R46 | 1K ohms |
| 1 | R34 | 15K ohms |
| 1 | R16 | 6K8 ohms |
| 1 | R18 | 27K ohms |
| 1 | R19 | 36K ohms |
| 1 | R32 | 6K8 ohms |
| 2 | R24, R20 | 75K ohms |
| 5 | R26, R27, R28, R29, R30 | 180 ohms |
| 1 | R35 | 22K ohms |
| 9 | R38, R39, R22, R25, R26, R27, R28, R29, R30 | 180K ohms |
| | MISCELLANEOUS | |
| 1 | S1 | POWER SWITCH |
| 3 | S2, S5, S6 | RESET BUTTON |
| 1 | S3 | SW SPTT SWITCH |
| 1 | S4 | VOLUME SWITCH |
| 4 | U1, U2, U3, U4 | LM324 AMPLIFIERS |
| 1 | X1 | MICROPHONE |
| 1 | J1 | 9 V BATTERY |
| 1 | J2 | PHONEJACK |
| 1 | B1 | BEEPER PKM29-3AO MURATA ERIE |

Referring to FIG. 4, terminal 50 of microphone 18 is connected to junction 54 and power supply $V_{cc}$ through resistor $R_1$. Terminal 52 of the microphone is connected to ground. Junction 54 is connected to terminal 56 of amplifier $U_{1B}$ through capacitor $C_7$, resistor $R_{11}$ and junction 58. Resistor $R_{22}$ is between junction 58 and junction 60 which is connected to the output terminal 61 of amplifier $U_{1B}$. The resistors $R_{11}$ and $R_{22}$ provide an AC gain of 18 for the inverting amplifier $U_{1B}$.

Junction 60 is connected to junction 62 through capacitor $C_8$ which in turn is connected to junction 64 through resistor $R_{13}$. Junction 64 is connected to junction 66 which is connected to terminal 68 of operational amplifier $U_{1A}$. Junction 66 is also connected to junction 72 which is connected to output terminal 74 of the amplifier $U_{1A}$. Terminal 76 of the amplifier is connected to ground through junction 80 and zener diode $D_{14}$ and also to $V_{cc}$ through resistor $R_{10}$. Junction 72 is connected to ground through junction 82 and capacitor $C_4$. Junction 82 is connected to junctions 83 and 84. Input terminal 86 of amplifier $U_{1C}$ is connected to junction 62.

Referring to the rectification and filtering circuit 28, output terminal 61 of amplifier $U_{1B}$ is connected to junction 60 and then to junction 62 through capacitor $C_8$. Junction 62 is connected to non-inverting input terminal 88 of inverting amplifier $U_{1C}$. Terminal 90 of the amplifier is connected to junction 92 which is connected to output terminal 94 through diode $D_{11}$. Junction 92 is connected to the power supply $V_{cc}$ through capacitor $C_9$. Junction 92 is also connected to junction 95, which is connected to the power supply through resistor $R_{12}$. The output of amplifier $U_{1C}$ is configured as a superdiode using diode $D_{11}$. This, along with $C_9$ and $R_{12}$ give a DC voltage proportional to the amplitude of the AC signal received by amplifier $U_{1C}$.

The DC signal from terminal 94 is further amplified using inverting amplifier $U_{1D}$. Junction 95 is connected to non-inverting input terminal 100 of the amplifier. Inverting input terminal 102 of the amplifier is connected to junction 104 which is connected to junction 64 through resistor $R_2$ and to junction 106 through resistor $R_{20}$. Junction 106 is connected to junction 108 through resistor $R_{19}$. Junction 108 is connected to junction 109 through resistor $R_{18}$. Junction 109 is connected to output terminal 112 of amplifier $U_{1D}$ through junction 110. Junctions 106 and 108 are also connected together through level switch $S_3$. The gain of amplifier $U_{1D}$ is determined by resistors $R_{12}$, $R_{20}$, $R_{19}$, and $R_{18}$. The gain of the amplifier can be changed with level switch $S_3$. With the switch in the MED position the gain is 10. In the LO position the gain increases to about 12. In HI position the gain is about 7.

The output voltage of $U_{1D}$ is therefore a DC level that corresponds to the sound level present at microphone 18. A larger sound level is represented by a lower voltage. This DC signal is then used to activate LED's $D_5$, $D_7$, $D_9$, $D_2$ and $D_3$. Amplifiers $U_{3A}$, $U_{3B}$, $U_{3C}$, $U_{3D}$ and $U_{4A}$ act as comparators and determine which of the LED's lights when the apparatus 10 is operational. The trip levels for these comparators is achieved by using the different voltages available at voltage divider 113, which comprises resistors $R_{31}$, $R_{32}$, $R_{33}$, $R_{34}$, and $R_{35}$. Junction 84, which is connected to output terminal 74 of the operational amplifier $U_{1A}$ through junctions 72, 82 and 83, is connected to junction 114 through a resistor $R_{31}$. Junction 114 is connected to junction 115 through resistor $R_{32}$. Junction 115 is connected to junction 116 through resistor $R_{33}$. Junction 116 is connected to junction 117 through resistor $R_{34}$. Junction 117 is connected to junction 118 through resistor $R_{35}$.

Junction 122 is connected to non-inverting input terminal 124 of amplifier $U_{3A}$ and to switch $S_3$. Junction 122 is also connected to junctions 123, 110, 127 and 128 which are connected to non-inverting input terminals 125, 130, 131 and 132 of the amplifiers $U_{3B}$, $U_{3C}$, $U_{3D}$ and $U_{4A}$. Inverting input terminals 134, 135, 136, 137 and 138 of the amplifiers $U_{3A}$, $U_{3B}$, $U_{3C}$, $U_{3D}$ and $U_{4A}$ are connected to junctions 114, 115, 117 and 118 respectively. Terminal 140 of amplifier U3A is connected to power source $V_{cc}$, while terminal 142 is connected to ground. The equivalent terminals of amplifiers $U_{3B}$, $U_{3C}$, $U_{3D}$ and $U_{4A}$ are similarly connected. Output terminal 144 of amplifier $U_{2A}$ is connected to LED $D_5$ through resistor $R_{26}$. The LED is also connected to the power source through junction. In a similar manner, output terminals 145, 146, 147 and 148 of amplifiers $U_{3B}$, $U_{3C}$, $U_{3D}$ and $U_{4D}$ are connected to LED's $D_7$, $D_9$, $D_2$ and $D_3$ through resistors $R_{27}$, $R_{28}$, $R_{29}$ and $R_{30}$.

The output signal of amplifier $U_{1D}$ is fed from junction 128 to non-inverting input terminal of amplifier $U_{4B}$ through resistor $R_{41}$ and junctions 152 and 158. Junction 152 is connected to the power source $V_{cc}$ through reset button $S_2$. Junction 152 is also connected to the power source $V_{cc}$ through junction 153 and capacitor $C_2$. Junction 158 is connected to junction 160 through diode $D_{15}$. Junction 160 is connected to output terminal 162 of amplifier $U_{4B}$. Amplifier $U_{4B}$ and diode $D_{15}$ act as a latching comparator 164. Resistor $R_{41}$ and capacitor $C_2$ act as a low pass filter. The latching comparator 164 may be taken out of its latched state by pressing reset button $S_2$. When the latching comparator 164 is activated, its output stays low and enables oscillator 166 built up around amplifier $U_{4D}$, resistors $R_5$, $R_6$, $R_7$, and $R_8$, as well as capacitor $C_1$. Junction 160, connected to output terminal 162 of amplifier $U_{4B}$, is connected to diode $D_1$ which in turn in connected to junction 168. This junction is connected to ground through capacitor $C_1$, as well as to junction 170. Junction 170 is connected to inverting input terminal 172 of amplifier $U_{4D}$ and to junction 174 through resistor $R_8$. Junction 174 is connected to junction 176 which is connected to output terminal 178 of the amplifier. Non-inverting input 180 of the amplifier is connected to junction 182 which in turn is connected to junction 176 through resistor $R_7$. Junction 182 is connected to junction 184 which is connected to ground through resistor $R_5$, and to the power supply $V_{cc}$ through resistor $R_6$.

The output from oscillator 166 has a frequency of slightly greater than 1 Hz. This output from junction 174 is then used to activate beeper oscillator 190 composed of npn transistor $Q_1$ and related components. The output from the oscillator 166 is fed from junction 174 to junction 192 through resistor $R_{16}$. Junction 192 is connected to the power source through resistor $R_{15}$ and to non-inverting input terminal 194 of amplifier $U_{4C}$. Inverting input terminal 196 of $U_{4C}$ is connected to junction 198 which in turn is connected to junction 120. Output terminal 200 of $U_{4C}$ is connected to base 201 of transistor $Q_3$ through resistor $R_{23}$. The collector 199 of $Q_3$ is connected to junction 202 while its emitter 203 is grounded. Junctions 202 and 204 are also connected together through resistor $R_{37}$. Junctions 202 and 204 are also connected to volume switch $S_4$. Junction 204 is connected to collector 209 of transistor $Q_1$ through junction 206, resistor $R_4$ and junction 208. Base 210 of the transistor is connected to junction 206 through resistor $R_3$. Emitter 212 is connected to junction 214. Junction 214 is connected to terminal 216 of beeper 218 and to junction 204 through resistor $R_{36}$. Terminal 220 of the beeper is connected to junction 208 through junction 207, while terminal 222 is connected to junction 206. The purpose of amplifier $U_{4C}$ is to allow beeper 218 to be activated for a short instant upon turning on the power so that the user is assured that the beeper is working. The duration of the initial beep is determined by capacitor $C_3$ and resistor $R_9$, each of which is connected between junction 120 and ground. Junction 120 is connected to junction 198.

The output of the operational amplifier $U_{1A}$ is fed to inverting input terminal 224 of amplifier $U_{2C}$ through junctions 72, 82, 83 and 84. Non-inverting input terminal 226 of the amplifier is connected to junction 228 which is connected to ground through resistor $R_{21}$ and to power supply 40 through resistor $R_{24}$.

As discussed above, the power supply 40 includes a battery $J_1$ which has a positive terminal 229 connected to junction 231 through phone jack $J_2$ and power switch $S_1$. Junction 231 is connected to junction 228 through the resistor $R_{24}$. Terminal 230 of the battery is connected to ground through junction 233 which is also connected to phone jack $J_2$. An ac adaptor may be connected to the jack to power the circuit. The battery is then disconnected.

Power regulation is accomplished by npn transistor $Q_2$, diode $D_{13}$ and associated components. Junction 231 is connected to collector 240 of the transistor. The base 241 of the transistor is connected to junction 242, while the emitter of the transistor is connected to junction 244. Junction 244 is connected to ground through capacitor $C_6$ and to the power source.

Junction 242 is connected to ground through capacitor $C_5$ and to junction 246. Junction 246 is connected to junction 231 through resistor $R_{14}$ and to ground through Zener diode $D_{13}$. The battery voltage is essentially regulated down to about 6 v to power the circuit. This avoids circuit misoperation due to a weak battery.

The comparator $U_{2C}$ is used to detect a low battery situation by comparing the divided battery voltage to the reference voltage obtained from the operational amplifier. If the battery voltage is low, then LED $D_4$ will be illuminated whenever the power is on.

Junction 83 is connected to junction 298 which is connected to junction 302 which in turn is connected to non-inverting input terminal 304 of amplifier $U_{2B}$ and inverting input terminal 306 of amplifier $U_{2D}$. Junction 298 is also connected to inverting input terminal 308 of amplifier $U_{2A}$. Non-inverting input terminal 310 of the amplifier is connected to junction 312 which is connected to reset button $S_5$ and to reset button $S_6$ through junction 314. Junction 312 is connected to $V_{cc}$ through resistor $R_{42}$ while junction 314 is connected to ground through resistor $R_{43}$.

The reset button $S_5$ is connected to $V_{cc}$ through resistor $R_{45}$. Reset button $S_6$ is connected to ground through resistor $R_{46}$.

Output terminal 320 of amplifier $U_{2A}$ is connected to junction 300 which is connected to inverting input terminal 322 of amplifier $U_{2B}$ and non-inverting input terminal 324 of $U_{2D}$.

Output terminal 326 of $U_{2B}$ is connected to LED $D_6$ through resistor $R_{38}$. The LED is connected to $V_{cc}$ through junction 330. Similarly output terminal 328 of $U_{2D}$ is connected to LED $D_8$ through resistor $R_{39}$ while the diode is connected to $V_{cc}$ by junction 332.

Actuation of HIS and HER LED's $D_6$ and $D_8$ is achieved by amplifier $U_{2A}$ and related components. Amplifier $U_{2A}$ is set up as a Schmitt trigger comparator using $R_{44}$, $R_{42}$ and $R_{43}$. The comparator maintains its current high or low state until the threshold is exceeded by shorting out switches $S_5$ and $S_6$. With the inverting input of the comparator at a fixed reference, depressing one of the switches causes the voltage at the non-inverting input to exceed the references and thereby change the state of the comparator. Resistors $R_{45}$ and $R_{46}$ limit the current if both switches are pushed simultaneously.

The op-amps $U_{2B}$ and $U_{2D}$ buffer the output of $U_{2A}$ to activate the HIS and HER LED's.

The circuitry described above is all analog in nature. This includes the amplification, rectification and comparison circuitry. Alternatively, some of the analog circuitry could be replaced by digital logic or a processor. For example, the analog circuitry could be retained for amplification of the input signal, the rectification to obtain a DC level, for filtering and the comparators to determine if certain thresholds have been exceeded. The remaining functions for turning on the LED's and sounding the piezo buzzer could be controlled by a programmable logic array. As a further alternative a processor could be used to do the decision making. The analog circuitry for amplification, rectification and filtering would be retained. The signal could then be fed into the processor via an analog to digital converter and then compared to the thresholds corresponding to the various LED's. The processor could then decide on whether or not to sound the alarm through the piezo buzzer.

It will be understood by someone skilled in the art that many of the details above can be altered or deleted without departing from the scope of the invention which is to be interpreted with reference to the following claims:

What is claimed is:

1. A monitoring device which promotes rational discussions by warning persons when their voice levels exceed a preset amplitude, the device comprising:

an electrical power source, an electrical circuit and a microphone connected to the circuit for producing an electrical signal related to the amplitude of sound received by the microphone, the circuit including an AC amplifier coupled with the microphone for amplifying the electrical signal, a rectifier coupled with the AC amplifier for rectifying the amplified electrical signal, a DC amplifier for amplifying the recalled signal, a plurality of comparators, each said comparator having one input coupled with the rectifier to receive the rectified signal, one input which receives a reference voltage and an output which produces a comparator output, a first said comparator being coupled to a differential amplifier which produces an output only if the output of said first comparator is produced for at least as long as a preset length of time, the differential amplifier being coupled with an audible signaling device including an oscillator and a piezo-electric buzzer which is sounded when the first comparator produces an output indicating that the voice levels of the persons exceed the preset amplitude long enough for the differential amplifier output to be produced, a second said comparator being coupled to an LED and having a different reference voltage than the first comparator so the LED lights at a voice level below that which causes the buzzer to sound.

* * * * *